United States Patent [19]

Helm

[11] Patent Number: 4,992,787

[45] Date of Patent: Feb. 12, 1991

[54] METHOD AND APPARATUS FOR REMOTE SIGNAL ENTRY INTO MEASUREMENT WHILE DRILLING SYSTEM

[75] Inventor: Walter A. Helm, Plainville, Conn.

[73] Assignee: Teleco Oilfield Services Inc., Meriden, Conn.

[21] Appl. No.: 247,033

[22] Filed: Sep. 20, 1988

[51] Int. Cl.[5] ..... G01V 1/00

[52] U.S. Cl. ..... 340/854; 340/853

[58] Field of Search ..... 340/853, 854, 855; 367/81, 82, 83; 175/24, 40, 45; 324/345, 346

[56] References Cited

U.S. PATENT DOCUMENTS

| | | | |
|---|---|---|---|
| 2,379,800 | 7/1945 | Hare | 340/854 |
| 2,992,325 | 7/1961 | Lehan | 340/855 |
| 3,993,127 | 11/1976 | Chepler et al. | 340/853 |
| 4,057,781 | 11/1977 | Scherbatskoy | 340/856 |
| 4,646,277 | 2/1987 | Bndes et al. | 340/854 |
| 4,725,837 | 2/1988 | Rubin | 340/854 |
| 4,736,204 | 4/1988 | Davison | 340/356 |
| 4,739,325 | 4/1988 | MacLeod | 340/854 |

OTHER PUBLICATIONS

EP 0273379 A (Radic Co Ltd).
Well Data Transmission System Using A Magnetic Drill String For Transmitting A Magnetic Flux Signal, Inventor—Nobuyoshi Yamazaki.

*Primary Examiner*—Brian S. Steinberger
*Attorney, Agent, or Firm*—Fishman, Dionne & Cantor

[57] ABSTRACT

A method and apparatus for remote signal entry of control or data information from an equipment operator into an MWD system is presented. In accordance with an important feature of the present invention, the magnetometer, which is typically present in commercial MWD systems, is used as a communications channel for remote (e.g. wireless) transfer of data and/or control commands into the MWD tool. The present invention functions by replacing the direct electrical RS232 coupling with a wireless magnetic link. The invention uses the RS232 output of the operator's computer to drive its power amplifier which in turn drives the field coils in a transmitter. The axis of the field coils must be aligned with one of the sensitive axes of the magnetometer which, as mentioned, is a pre-exisitng part of the directional measurement system of the MWD apparatus. Thus, the present invention overcomes the necessity in the prior art for a direct RS232 link up between the surface computer and the computer on the MWD tool.

8 Claims, 6 Drawing Sheets

WIRELESS COMMUNICATION LINK

METHOD AND APPARATUS FOR REMOTE SIGNAL ENTRY INTO MEASUREMENT WHILE DRILLING SYSTEM

BACKGROUND OF THE INVENTION

This invention relates to the field of measurement while drilling (MWD) and borehole telemetry. More particularly, this invention relates to a method and apparatus for wireless or remote communication of control or data information from the equipment operator to the MWD system.

In the field of borehole drilling, particularly oil and gas well drilling, the usefulness of systems capable of detecting parameters at the bottom of the drill string and transmitting such data to the surface during the course of drilling has long been recognized. Mud pulse telemetry systems are known and in commercial use for measuring while drilling. Such systems are shown, for example, in U.S. Pat. Nos. 3,982,431; 4,013,945 and 4,021,774 all of which are assigned to the assignee hereof.

An MWD system is comprised of various borehole sensors combined with a computer controlled data acquisition system and a mud pulse telemetry system. In use, an MWD system is exposed to extremes of mechanical stress due to shock and vibration, hydrostatic pressure of the mud, and temperature. These extremes require that the electronics be contained in a package of high integrity. Further, this package is placed inside a drill collar making access difficult.

Changing drilling conditions often make it desirable to be able to affect changes in the operating parameters of the MWD system at the rig site. It is commonly understood that by interconnecting two computers at the surface using an interface as described in EIA Standard RS232, a hard wired communications link can be established. Once established, data, control or programs can be transferred between the computers.

Unfortunately, the use of a RS232 communications link suffers from certain problems. For example, electrical connectors must be provided to the effect the RS232 link. In the MWD tool, this connector is associated with an opening through the drill collar. It will be appreciated that adding the necessary features (such as the opening through the drill collar) for effecting direct electrical connection to the MWD tool can add considerable cost to the MWD system as well as increase the risk of system failure in downhole use.

SUMMARY OF THE INVENTION

The above discussed and other drawbacks and deficiencies of the prior art are overcome or alleviated by the method and apparatus for remote signal entry of control or data information from an equipment operator into the MWD system. In accordance with an important feature of the present invention, the magnetometer, which is typically present in commercial MWD systems, is used as a communications channel for remote (e.g. wireless) transfer of data and/or control commands into the MWD tool. The present invention functions by replacing the direct electrical RS232 coupling with a wireless magnetic link. The invention uses the RS232 output of the operator's computer to drive its power amplifier which in turn drives field coils in a transmitter. The axis of the field coils must be aligned with one of the sensitive axes of the magnetometer which, as mentioned, is a pre-existing part of the directional measurement system of the MWD apparatus.

Thus, the present invention overcomes the necessity in the prior art for a direct RS232 link up between the surface computer and the computer on the MWD tool.

The above-discussed and features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGS.

Figure 1:
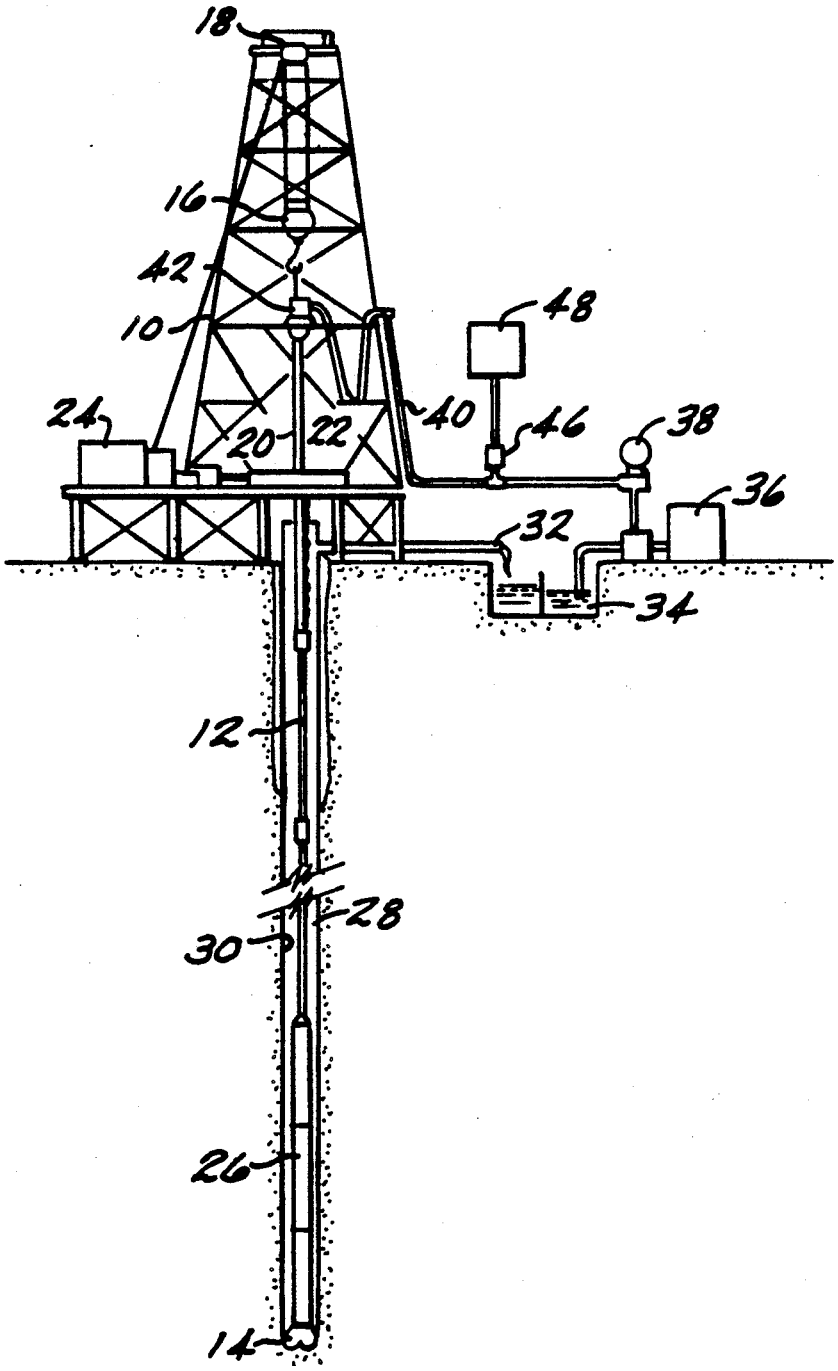
FIG. 1 is a generalized schematic view of a borehole and drilling derrick showning the environment for the present invention.
Figure 2:
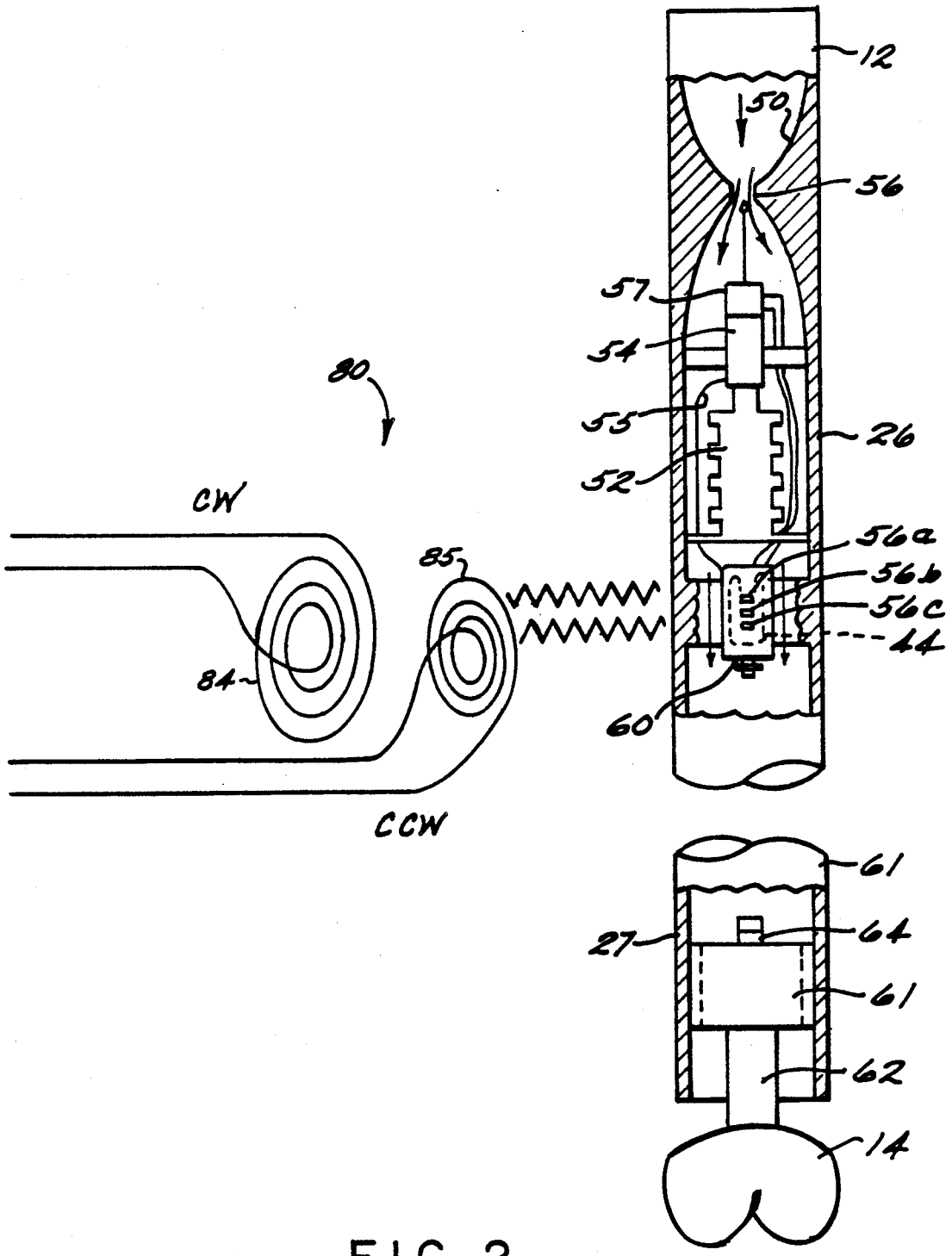
FIG. 2 is a front elevation view, partly in cross section, of a borehole measurement-while-drilling (MWD) system.

DESCRIPTION OF THE PREFERRED EMBODIMENT:

Referring first to FIGS. 1 and 2, the general environment is shown in which the present invention is employed. It will, however, be understood that these generalized shownings are only for purposes of showing a representative environment in which the present invention may be used, and there is no intention to limit applicability of the present invention to the specific configuration of FIGS. 1 and 2.

The drilling apparatus shown in FIG. 1 has a derrick 10 which supports a drill string or drill stem 12 which terminates in a drill bit 14. As is well known in the art, the entire drill string may rotate, or the drill string may be maintained stationary and only the drill bit rotated. The drill string 12 is made up of a series of interconnected segments, with new segments being added as the depth of the well increases. In systems where the drill bit turbine driven, it is often desirable to slowly rotate the drill string. That can be accomplished by reactive torque from the drilling, or by actual rotation of the drill string from the surface. To that latter end, the drill string is suspended from a movable block 16 of a winch 18, and the entire drill string may be driven in rotation by a square kelly 20 which slidably passes through but is rotatably driven by the rotary table 22 at the foot of the derrick. A motor assembly 24 is connected to both operate winch 18 and rotatably drive rotary table 22.

The lower part of the drill string may contain one or more segments 26 of large (diameter than other segments of the drill string known as drill collars). As is well known in the art, these drill collars may contain sensors and electronic circuitry for sensors, and power sources, such as mud driven turbines which drive drill bits and/or generators and, to supply the electrical energy for the sensing elements.

Drill cuttings produced by the operation of drill bit 14 are carried away by a large mud stream rising up through the free annular space 28 between the drill string and the wall 30 of the well. That mud is delivered via a pipe 32 to a filtering and decanting system, schematically shown as tank 34. The filtered mud is then sucked by a pump 36, provided with a pulsation absorber 38, and is delivered via line 40 under pressure to a revolving injector head 42 and then to the interior of drill string 12 to be delivered to drill bit 14 and the mud turbine if a mud turbine is included in the system.

The mud column in drill string 12 also serves as the transmission medium for carrying signals of downhole parameters to the surface. This signal transmission is accomplished by the well known technique of mud pulse generation whereby pressure pulses are generated in the mud column in drill string 12 representative of sensed parameters down the well. The drilling parameters are sensed in a sensor unit 44 (see FIG. 2) in a drill collar 26 near or adjacent to the drill bit. Pressure pulses are established in the mud stream within drill string 12, and these pressure pulses are received by a pressure transducer 46 and then transmitted to a signal receiving unit 48 which may record, display and/or perform computations on the signals to provide information of various conditions down the well.

Referring briefly to FIG. 2, a schematic system is shown of a drill string segment 26 in which the mud pulses are generated. The mud flows through a variable flow orifice 50 and is delivered to drive a first turbine 52. This first turbine powers a generator 54 which delivers electrical power to the sensors in sensor unit 44 (via electrical lines 55). The output from sensor unit 44, which may be in the form of electrical, hydraulic or similar signals, operates a plunger 56 which varies the size of variable orifice 50, plunger 56 having a valve driver 57 which may be hydraulically or electrically operated. Variations in the size of orifice 50 create pressure pulses in the mud stream which are transmitted to and sensed at the surface to provide indications of various conditions sensed by sensor unit 44. Mud flow is indicated by the arrows.

Since sensors in sensor unit 44 are magnetically sensitive, the particular drill string segment 26 which houses the sensor elements must be a non-magnetic section of the drill string, preferably of stainless steel or monel. Sensor unit 44 is further encased within a non-magnetic pressure vessel 60 to protect and isolate the sensor unit from the pressure in the well.

While sensor unit 44 may contain other sensors for directional or other measurement, it will contain a triaxial magnetometer with three windings, those windings being shown separately, merely for purposes of illustration and description, as windings 56A, 56B, and 56C, being respectively the "x", "y" and "z" magnetometer windings. As is well known, the magnetometer 56A–C normally measures direction and magnitude of the earth's magnetic field with respect to the MWD system's local coordinates.

A drilling turbine 61 is positioned below sensor assembly 44. Frequently, another segment 27 of non-magnetic drill collar extends between sensor assembly 44 and turbine 61.

The shaft of drilling turbine 61 has a lower or downwardly extending section 62 which is connected to and drives drill bit 14 and an upwardly extending section 64.

Figure 3:
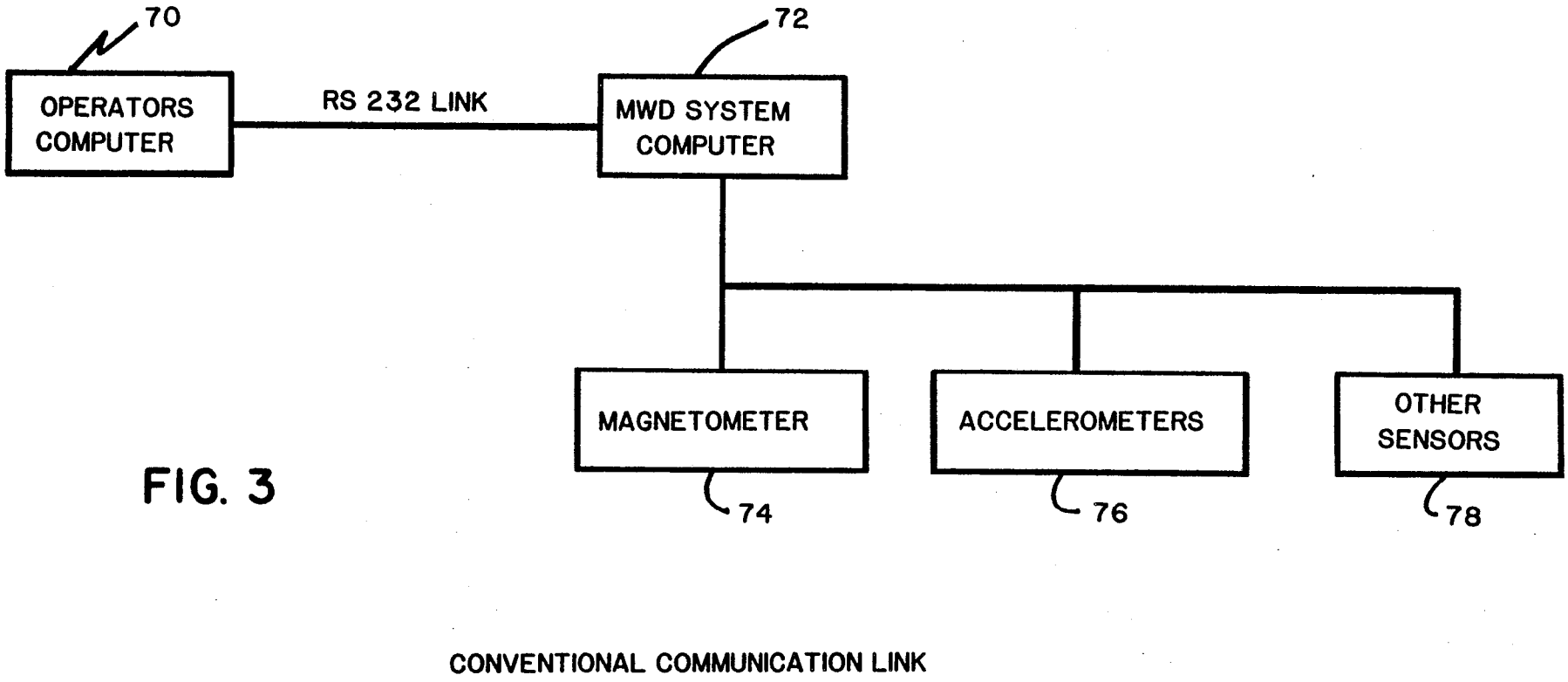
FIG. 3 is a block diagram of a prior art surface communications link with an MWD tool.

There is often a need to effect changes in the operating parameters of the MWD system at the rig site. Such changes are typically effected by bringing the MWD tool to the surface at the rig site and forming a direct hard wire communications link between the MWD onboard computer system and the operator's computer which is located on the drill rig itself (see item 48 in FIG. 1). Such a conventional communications link is shown in FIG. 3 wherein an RS 232 link up is shown between the operator's computer 70 and the computer system on the MWD tool 72. As also shown in FIG. 3, the MWD system computer 72 electronically communicates with the magnetometer 74 (corresponding to elements 56A, 56B and 56C in FIG. 2), accelerometer 76 and other known sensors 78.

The prior art conventional communications link of FIG. 3 suffers from several deficiencies. For example, the provision of the necessary features for effecting direct electrical connection to the MWD tool can add considerable cost to the MWD system as well as increase the risk of system failure in downhole use. This is particularly troublesome when an opening must be provided through the drill collar of the MWD tool to effect a direct RS232 hardwired link up.

Figure 4:
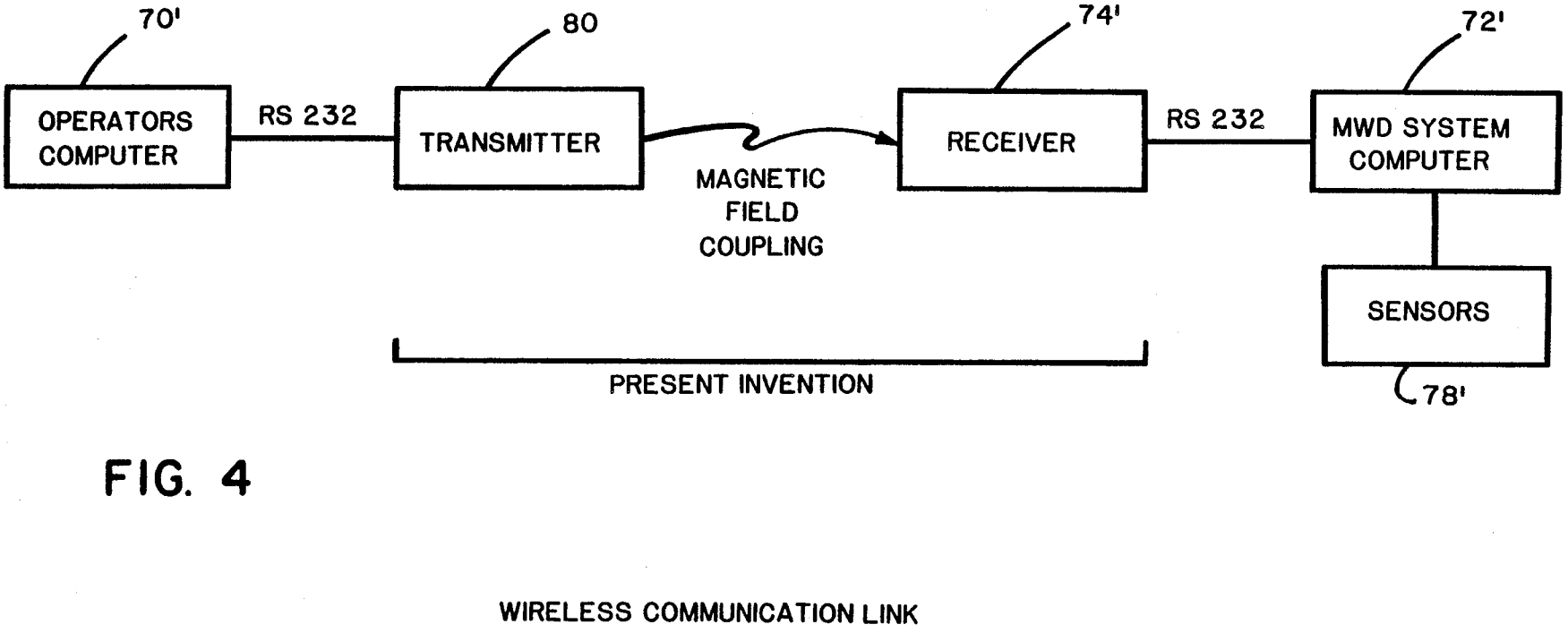
FIG. 4 is a block diagram of a wireless surface communications link with an MWD tool in accordance with the present invention.
Figure 5:
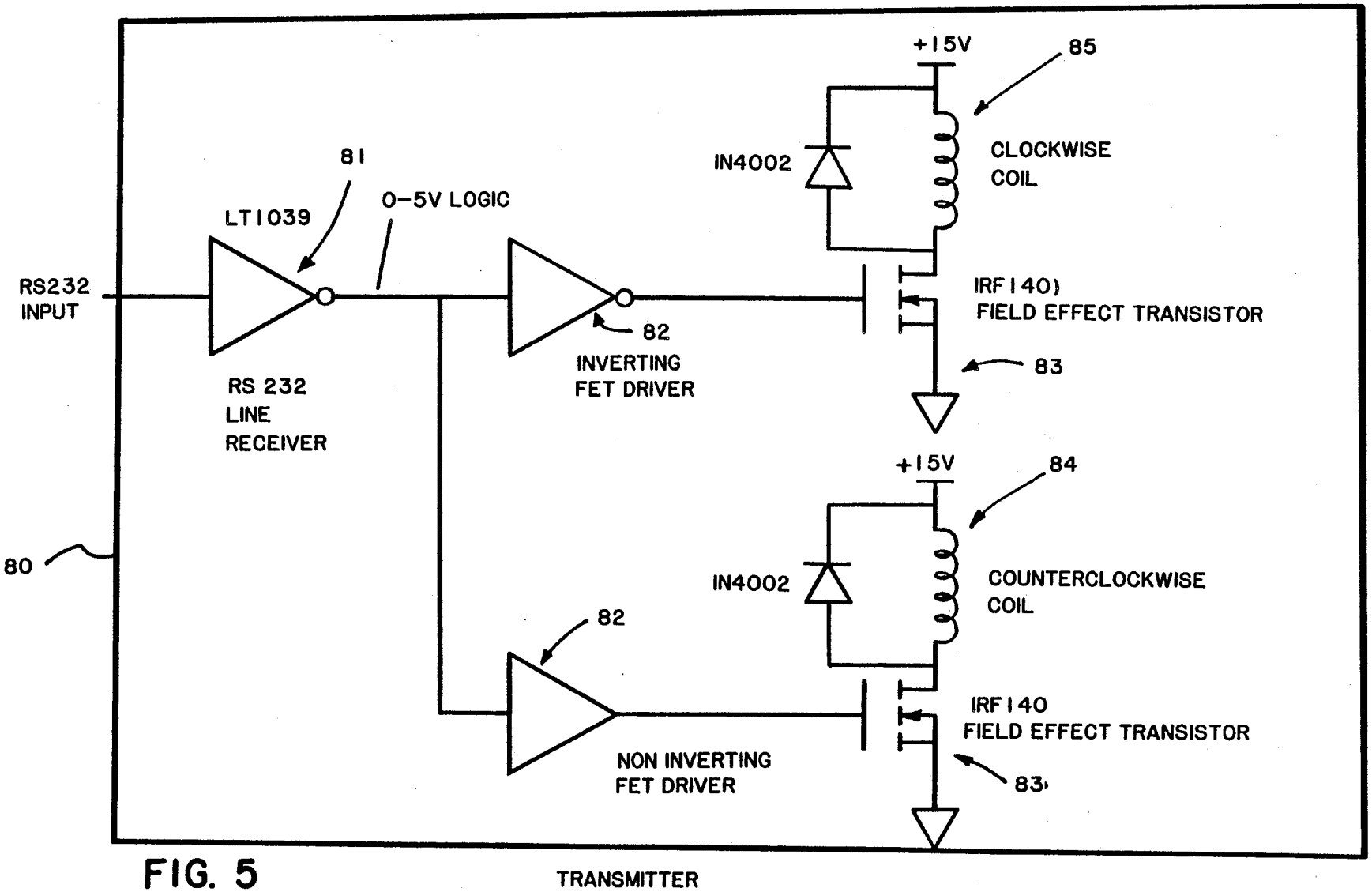
FIG. 5 is an electrical schematic of a transmitter used in the system of FIG. 4.
Figure 6:
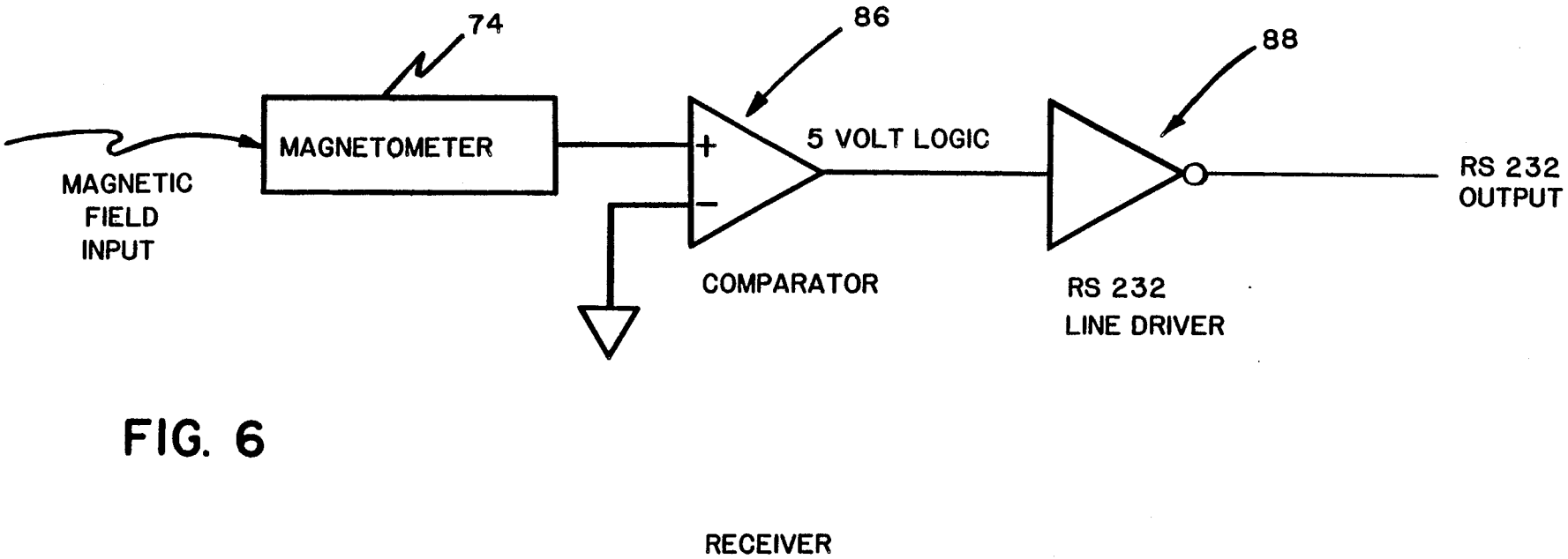
FIG. 6 is a block diagram of the receiver used in the system of FIG. 4.

Turning now to FIGS. 4–6, in accordance with the present invention, a method and apparatus is provided for remote signal entry of control or data information from an equipment operator into the MWD system at the surface of the drill rig. As shown in FIG. 4, the present invention utilizes transmitter means 80 which effect a remote or wireless communications link with a receiver 74' in the MWD tool. As will be discussed in more detail hereinafter, an important feature of the present invention is that the wireless receiver 74' is actually a magnetometer shown at 56 in FIG. 2; and which is an existing feature of conventional MWD systems. Thus, the present invention utilizes the magnetometer 74', which is already present in commercial MWD systems, as a communications channel for remote transfer of data and/or control commands into the MWD tool. This wireless communications link thus replaces the direct electrical RS232 coupling with a wireless magnetic link.

Referring simultaneously now to FIGS. 4–6, the operator's computer 70' has an RS232 input into transmitter 80. In transmitter 80, the RS232 signal from the operator's computer 70' is converted to five volt logic levels by the RS 232 line receiver 81. The output of line receiver 81 is used to drive the field effect transistor (FET) driver 82 which drives the FET 83. The FET thus driven acts as a switch to allow or inhibit current flow through the field coil windings 84 and 85. As alternate coils 84 and 85 are energized in accordance with the output of the RS232 line, a magnetic field of alternating polarity is produced. The coils 84 and 85 of FIG. 5 are illustrated schematically in FIG. 2 wherein a clockwise coil is identified at 84 and a counterclockwise coil is identified at 85. Coils 84 and 85 will be aligned with any one of the "x", "y"or "z" windings in the magnetometer 56. In the particular embodiment shown in FIG. 2, windings 84 and 85 have been aligned with the "x" magnetometer winding 56B. It will be appreciated that the several electronic components identified in the schematic of FIG. 5 are all commercially available and known to a person of ordinary skill in the art. Coils 84 and 85 may comprise 12 inch diameter coils having 150 turns of No. 20 AWG copper wire.

Referring now to FIGS. 4 and 6, it will be appreciated that in accordance with a very important feature of the present invention, the magnetometer 74' (or item 56 in FIG. 2) of the directional sensor is used as the transducer to convert the transmitter generated magnetic field back to an electrical signal. This is accomplished by using a comparator 86 for detecting the transitions through zero of the magnetic field conditions. The comparator output drives an RS232 line driver 88 which then channels information to the MWD system computer 72'. During operation, the output of line driver 88 will carry the same information content as the RS232 input identified in FIG. 5.

It will be appreciated that a RS-232 link is well known to those of ordinary skill in the electronics field and is defined by the Electronics Industries Association standard EIA RS-232-C.

A key feature of the present invention is that any computer system software written for the operator's computer and the MWD system computer for the purpose of effecting communication between the two computers can be used without consideration as to whether a direct electrical connection exists. Thus, data, control or other programs can be easily transferred from the operator's computer and into the computer onboard the MWD tool. Such a communications link is done via a remote connection without the need for a direct electrical interconnect.

Still another important feature of the present invention is that the receiving means used onboard the MWD tool may simply consist of a magnetometer which is an existing sensor found on all commercial MWD systems. The use of an existing sensor for the receiving means thereby precludes the necessity for providing a separate receiving unit leading to ease of use and lower manufacturing costs for the communications link up of this invention. The wireless communications link of the present invention will permit data rates of up to fifty bits per second which is particularly useful on the drill rig surface where time is at a premium.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for remote signal entry from first computer means into a measurement-while-drilling (MWD) system when the MWD system is located on the surface, the MWD system including existing magnetometer means and second computer means in an electronics package, the electronics package being supported inside a drill collar, the magnetometer means normally measuring direction and magnitude of the earth's magnetic field with respect to the MWD system's local coordinates, including the steps of:

generating a first signal from the first computer means when the MWD system is located on the surface;

converting said first signal to a magnetic field when the MWD system is located on the surface;

delivering said magnetic field to the electronics package in the MWD system using wireless delivery means when the MWD system is located on the surface;

detecting said magnetic field in the electronics package using said existing magnetometer means in said MWD system when the MWD system is located on the surface;

converting said detected magnetic field back to said first signal when the MWD system is located on the surface; and delivering said first signal to the second computer means using hardwired delivery means when the MWD system is located on the surface.

2. The method of claim 1 wherein said magnetometer means includes x, y and z windings and wherein the magnetic field is delivered by a pair of coils and including the step of:

aligning said pair of coils with one of the x, y or z windings on the magnetometer means.

3. The apparatus of claim 1 wherein:

said generating means comprises RS232 signal input means.

4. The apparatus of claim 1 wherein:

said first converting means comprises field effect transistor means.

5. The apparatus of claim 1 wherein:

said second converting means comprises comparator means, the output from the comparator means driving an RS232 line driver to define an RS232 output.

6. An apparatus for remote signal entry from first computer means into a measurement-while-drilling (MWD) system, when the MWD system is located on the surface, the MWD system including existing magnetometer means and second computer means in an electronics package, the electronics package being supported inside a drill collar, the magnetometer means normally measuring direction and magnitude of the earth's magnetic field with respect to the MWD system's local coordinates, comprising:

generating means for generating a first signal from the first computer means when the MWD system is located on the surface;

first converting means for converting said first signal to a magnetic field when the MWD system is located on the surface;

wireless delivery means for delivering said magnetic field to the electronics package in the MWD system when the MWD system is located on the surface;

detecting means for detecting said magnetic field in the electronics package, said detecting means comprising said existing magnetometer means in said MWD system when the MWD system is located on the surface;

second converting means for converting said detected magnetic field back to said first signal when the MWD system is located on the surface; and hardwired delivery means for delivering said first signal to the second computer means when the MWD system is located on the surface.

7. The apparatus of claim 6 wherein said magnetometer means includes x, y and z windings and wherein said delivery means comprises pair of coils, including a clockwise coil and a counterclockwise coil.

8. The apparatus of claim 7 wherein:

said pair of coils are aligned with said x, y or z windings of said magnetometer means.

* * * * *

UNITED STATES PATENT AND TRADEMARK OFFICE

CERTIFICATE OF CORRECTION

PATENT NO. : 4,992,787

DATED : Feb. 12, 1991

INVENTOR(S) : Walter A. Helm

It is certified that error appears in the above-identified patent and that said Letters Patent is hereby corrected as shown below:

| | |
|---|---|
| Col. 1, line 43, | Delete "the" before the word "effect". |
| Col. 2, line 15, | Delete "showning" and insert therefore -- showing --. |
| Col. 2, line 35, | Delete "shownings" and insert therefore -- drawings --. |
| Col. 2, line 48, | Insert -- is -- between "bit" and "turbine". |
| Col. 2, lines 59-60 | Delete "large (diameter than other segments of the drill string known as drill collars)." and insert therefore -- larger diameter than other segments of the drill string (known as drill collars).--. |

Signed and Sealed this

Twenty-second Day of June, 1993

*Attest:*

Michael K. Kirk

MICHAEL K. KIRK

*Attesting Officer*

*Acting Commissioner of Patents and Trademarks*